US009181948B2

(12) United States Patent
Assaf

(10) Patent No.: US 9,181,948 B2
(45) Date of Patent: Nov. 10, 2015

(54) LIQUID RING COMPRESSOR

(75) Inventor: Gad Assaf, Beer Sheva (IL)

(73) Assignee: AGAM ENERGY SYSTEMS LTD., Hod Hasharon (IL)

( * ) Notice: Subject to any disclaimer, the term of this patent is extended or adjusted under 35 U.S.C. 154(b) by 1320 days.

(21) Appl. No.: 11/917,153

(22) PCT Filed: Jun. 12, 2006

(86) PCT No.: PCT/IL2006/000680

§ 371 (c)(1),
(2), (4) Date: Dec. 11, 2007

(87) PCT Pub. No.: WO2006/134590

PCT Pub. Date: Dec. 21, 2006

(65) Prior Publication Data

US 2009/0290993 A1 Nov. 26, 2009

(30) Foreign Application Priority Data

Jun. 15, 2005 (IL) ..... 169162

(51) Int. Cl.

| | |
|---|---|
| ***F04C 19/00*** | (2006.01) |
| ***F01C 17/02*** | (2006.01) |
| ***F01C 21/08*** | (2006.01) |
| *F04C 29/04* | (2006.01) |

(52) U.S. Cl.

CPC ..... *F04C 19/002* (2013.01); *F01C 17/02* (2013.01); *F01C 21/0809* (2013.01); *F04C 29/042* (2013.01)

(58) Field of Classification Search

CPC ..... F04C 19/002

USPC ..... 417/68

See application file for complete search history.

(56) References Cited

U.S. PATENT DOCUMENTS

| | | | |
|---|---|---|---|
| 953,222 | A | 3/1910 | Nash |
| 1,463,646 | A | 7/1923 | Chilowsky |
| 2,201,575 | A | 5/1940 | Corneil et al. |

(Continued)

FOREIGN PATENT DOCUMENTS

| | | | |
|---|---|---|---|
| DE | 37 18 551 | A1 | 12/1988 |
| DE | 10 2006 049944 | A1 | 3/2008 |

(Continued)

OTHER PUBLICATIONS

Office Action correponding to co-pending European Patent Application No. 11 715 758.6-1608, dated Jun. 3, 2014 (6 pages).

*Primary Examiner* — Charles Freay
*Assistant Examiner* — Christopher Bobish
(74) *Attorney, Agent, or Firm* — Nixon Peabody LLP

(57) ABSTRACT

A liquid ring rotating casing compressor (LRRCC), including a shaft, an impeller having a core and a plurality of radially extending vanes rotatably coupled to the shaft, a tubular casing having an inner surface and an outer surface eccentrically rotatably disposed with the impeller and disc-shaped portions laterally coupled to the vanes and/or to the core. The casing defines with the impeller a compression zone, wherein edges of the vanes rotate in increasing proximity to an inner surface of the casing and an expansion zone and edges of the vanes rotate in increasing spaced-apart relationship along an inner surface of the casing. An inlet port communicates with the expansion zone, an outlet port communicates with the compression zone, and there is also provided a drive for rotating motion to the casing.

4 Claims, 2 Drawing Sheets

(56) References Cited

U.S. PATENT DOCUMENTS

| | | | | | |
|---|---|---|---|---|---|
| 2,937,499 | A | | 5/1960 | Klemt | |
| 4,112,688 | A | | 9/1978 | Shaw | |
| 4,747,752 | A | * | 5/1988 | Somarakis | 417/68 |
| 4,981,413 | A | * | 1/1991 | Elonen et al. | 415/115 |
| 5,122,035 | A | | 6/1992 | Juhola | |
| 5,636,523 | A | | 6/1997 | Assaf | |
| 5,722,255 | A | | 3/1998 | Brasz | |
| 6,412,291 | B1 | * | 7/2002 | Erickson | 62/87 |
| 2009/0290993 | A1 | | 11/2009 | Assaf | |

FOREIGN PATENT DOCUMENTS

| | | |
|---|---|---|
| FR | 865.434 | 5/1941 |
| FR | 999.464 | 1/1952 |
| WO | WO 96/22467 A1 | 7/1996 |
| WO | WO 2006/134590 | 12/2006 |

* cited by examiner

LIQUID RING COMPRESSOR

FIELD OF THE INVENTION

The present invention relates to Liquid Ring Compressors (LRC's) and more specifically to an LRC with a rotating casing.

BACKGROUND OF THE INVENTION

U.S. Pat. No. 5,636,523 discloses an LRC and expander having a rotating jacket, the teaching of which is incorporated herein by reference.

This known LRC, however, has several disadvantages: while the jacket is free to rotate by the liquid ring which is driven by the rotor, the velocity of the rotating casing lags behind the rotor's tips, rendering the flow unstable namely, causing inertial instability, especially when the angular momentum becomes smaller with large radiuses (the angular momentum of a liquid element located at a radius r is defined as the produces u•r, where u is the tangential velocity). As the liquid velocity near the jacket follows the jacket's velocity, when the jacket's velocity lags behind the rotor's velocity, the friction, which is formed between the liquid and the jacket and the liquids between the liquid ring and the rotor vanes, will cause instability in the compressor.

Furthermore, in the prior art LRC, the lateral disc-shaped walls of the compressor are stationary. Thus, the liquid ring which rotates around the wet stationary walls, will also generate friction, detracting from the overall efficiency of the compressor.

DISCLOSURE OF THE INVENTION

It is therefore a broad object of the present invention to overcome the above-described disadvantages and to provide a Liquid Ring Rotating Casing Compressor (LRRCC) in which the friction between the liquid ring and rotating casing is minimal.

It is a further object of the present invention to provide an LRRCC in which the lateral walls are not stationary, so as to reduce friction.

It is still a further object of the invention to provide an LRRCC in which the casing is driven at a velocity which is greater than 70% of the velocity of the impeller.

Another object of the present invention is to provide an LRRCC having a casing controllably driven by external means.

In accordance with the invention, there is therefore provided a liquid ring rotating casing compressor (LRRCC), comprising a shaft; an impeller having a core and a plurality of radially extending vanes rotatably coupled to said shaft, a tubular casing having an inner surface and an outer surface eccentrically rotatably disposed with said impeller, disc-shaped portions laterally coupled to said vanes and/or to said core; said casing defining with said impeller a compression zone wherein edges of said vanes rotate in increasing proximity to an inner surface of the casing and an expansion zone wherein edges of said vanes rotate in increasing spaced-apart relationship along an inner surface of the casing, an inlet port communicating with said expansion zone, an outlet port communicating with said compression zone, and a drive for imparting rotating motion to said casing.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is an isometric, partly exposed view, of the LRRCC, according to the present invention;

FIG. 2 is an isometric view of an impeller for the LRRCC, according to the present invention;

FIG. 3 is a cross-sectional view of the LRRCC along line III-III of FIG. 1, according to the present invention, and FIG. 4 is a cross-sectional view along line IV-IV of FIG. 3.

DETAILED DESCRIPTION OF PREFERRED EMBODIMENTS

Figure 1:
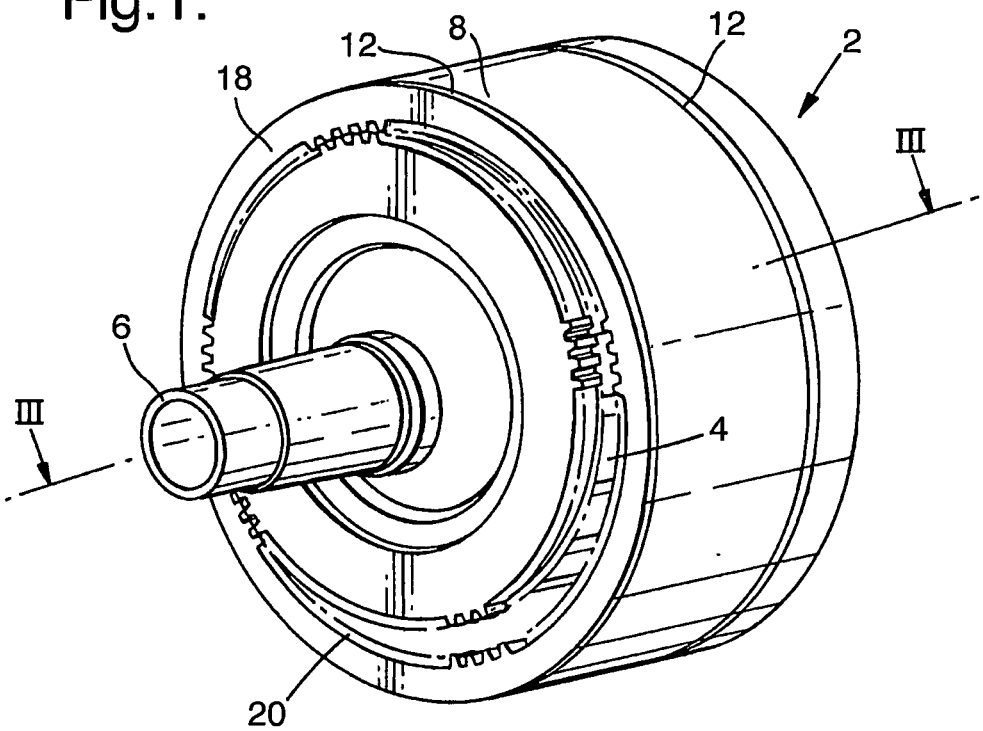
Figure 2:
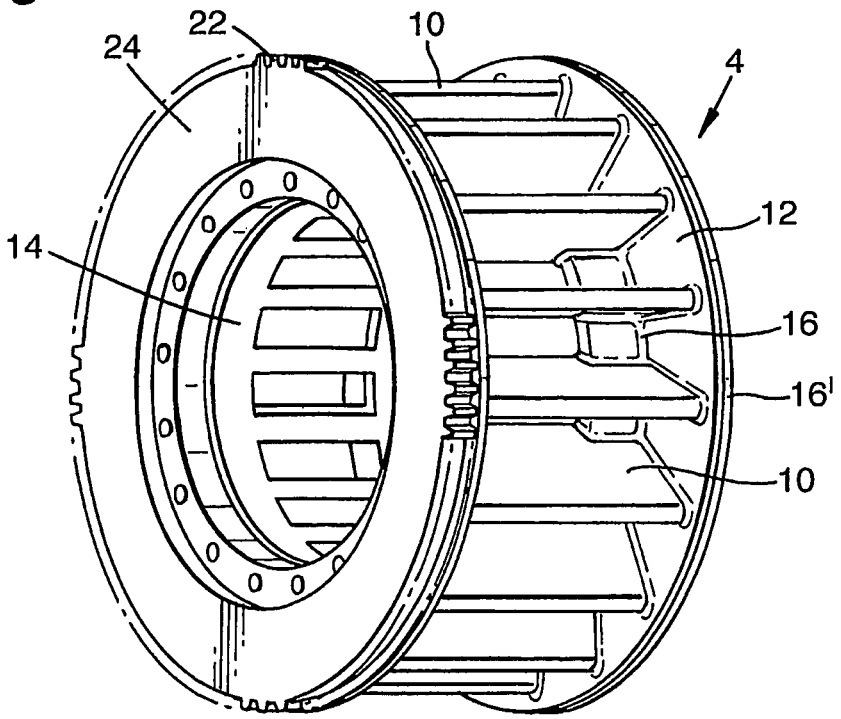

An isometric, partly exposed view of the LRRCC 2 according to the present invention is shown in FIG. 1. The compressor 2 having a general cylindrical shape, is composed of three major parts: an inner impeller 4 mounted on a shaft 6 and a casing 8, configured as a curved surface of a cylinder. The shaft 6 is stationary and advantageously hollow, and the impeller 4 is rotatably coupled thereon, as seen in detail in FIG. 3. The impeller 4 shown in FIG. 2 consists of a plurality of radially extending vanes 10 mounted about a core 14, and of ring-shaped side walls 12, having concentric inner edges 16 and outer edges 16'. Advantageously, as seen in the Figure, the vanes 10 terminate shorter than the outer edges 16 for reasons that will be discussed hereinafter. Further seen in FIG. 1 is the casing 8 eccentrically rotatably coupled with the impeller 4 and extending across the outer edges of the vanes 10 between the side walls 12. Optionally, the casing 8 is mechanically coupled to the impeller 4. For this purpose it is fitted with lateral rings 18 having internal teeth 20, configured to mesh with outer teeth 22 made on rings 24, which are attached to the outer sides of the side walls 12. Hence, when teeth 20 and 22 are meshed, the impeller 4 will rotate about the shaft 6 at a constant velocity with respect to the velocity of the casing 8. Preferably, the velocity of the casing 8 should be greater than 70% of the velocity of the impeller 4.

The eccentricity ecr of the casing 8 with respect to the impeller 4 is given by the formula:

$$ecr<(1-c)/3,$$

wherein ecr=e/R, where e is the distance between the impeller and casing axis and c is the ratio between the radius C of the shaft 6 and the radius R of the casing 8.

Figure 3:
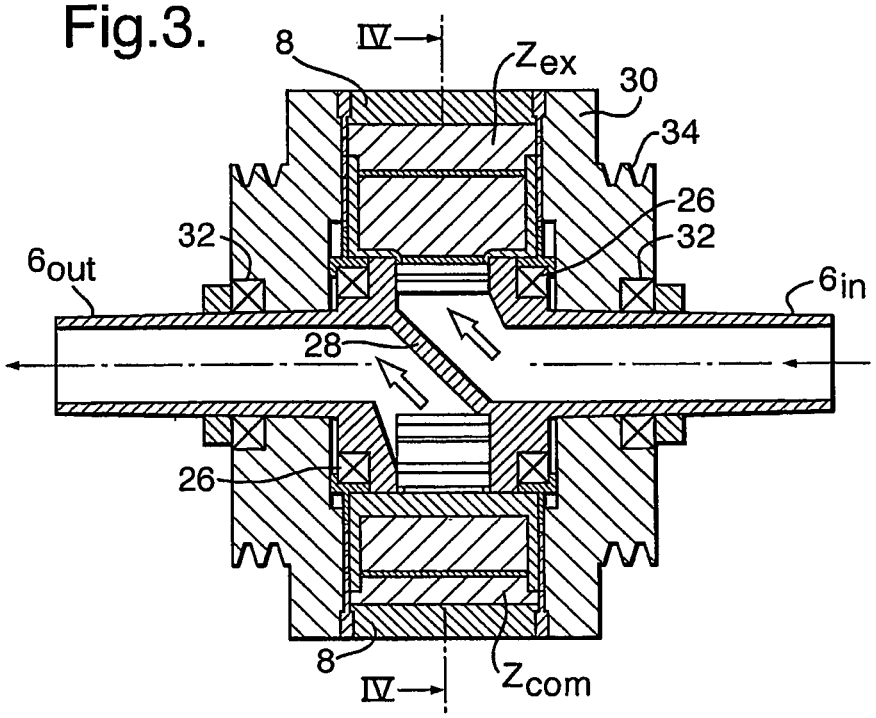
Figure 4:
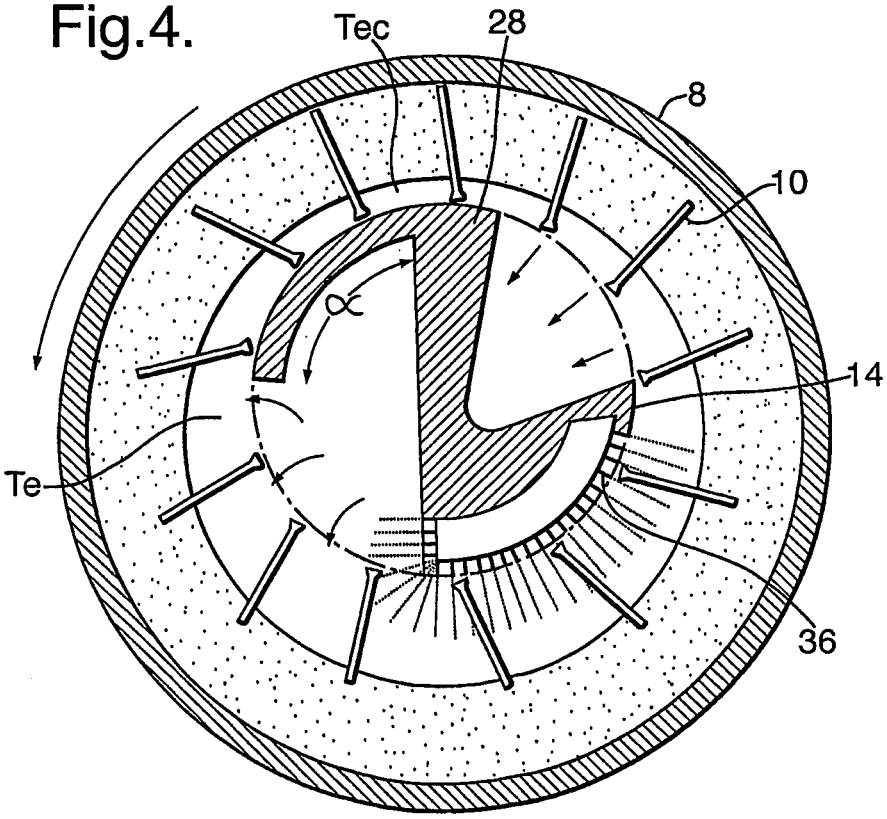

Referring now also to FIGS. 3 and 4, it can be seen that once the shaft mounted impeller and casing are assembled, there will be formed inside the casing 8 two distinct zones defined by the inner surface of the casing 8 and the impeller 4: a compression zone $Z_{com}$ where the edges of the vanes 10 are disposed and rotate in increasing proximity to the inner surface of the casing 8 and an expansion zone $Z_{ex}$ where the edges of the vanes 10 are disposed and rotate in increasing spaced-apart relationship along an inner surface of the casing 8. Also seen in FIG. 3 are bearings 26 coupling the impeller 4 on the shaft 6, the hollow shaft inlet portion $\mathbf{6}_{in}$ and an outlet portion $\mathbf{6}_{out}$ separated from the inlet portion $\mathbf{6}_{in}$ by a partition 28.

According to the present invention, the casing 8 is driven by an outside drive means such as a motor (not shown), coupled to the casing by any suitable means such as belts, gears, or the like. In FIG. 3 there is shown a casing, drive coupling means 30 mounted on the shaft 6 via bearings 32. The drive coupling means 30 may be provided on any lateral side of the casing 8, on both sides (as shown), or alternatively, the casing 8 may be driven by means provided on its outer surface. The ribs 34 are provided for guiding driving belts (not shown) leading to a motor.

The radial liquid flow near the border between the compression zone $Z_{com}$ and expansion zone $Z_{ex}$ is associated with high liquid velocity variations between the vanes 10 and the casing 8. This tangential velocity variation is dissipative. To reduce the dissipative velocity, in the present invention the ends of the vanes 10 are shorter as compared with the impeller's side walls 12. In this way, the distance between the ends of the vanes 10 and the casing 8 increases, the dissipative velocity is reduced and the efficiency increases.

In the compression zone $Z_{com}$ shaft work is converted to heat. In accordance with another feature of the present invention cold fluid can be introduced into the compression zone $Z_{com}$, thus heat will be extracted from the compression zone by the cold liquid. In this way, the compressed gas will be colder, further increasing the compressor's efficiency, as less shaft work is required to compress cold gas than hot gas.

In the preferred embodiment, the fluid (usually cold water) should be atomized and sprayed directly into the compression zone $Z_{com}$. To be effective, the droplet average diameter by volume should advantageously be smaller than 200 microns. In order to extract most of the generated heat and keep the air temperature at low levels the liquid mass flow ml (kg/s) should be comparable to the air mass flow, say ml>ma/3.

In FIG. 4, there are illustrated spray nozzles 36 formed in the core 14 about which the vanes 10 are mounted. As can be seen, the spray nozzles 36 may be formed on the partition 28, so as to direct atomized fluid in two directions.

In the compression zone $Z_{com}$ near the border or interface between the two zones liquid waves are developed. The waves are associated with leakage of compressed air to the expanding zone $Z_{ex}$, which is dissipative in nature. The wave's amplitude and with it, the leakage, increases with distance between two neighboring vanes. To reduce the leakage, the vane numbers should be larger than 10. Furthermore, it is required that the leakage air will expand at the expanding zone $Z_{ex}$. For this reason, the vanes 10 should be close to the central shaft 6, so that the interval between the vanes and the duct will be small and the angle $\alpha$ between the narrow point Tec and the opening to the low pressure inlet Te exceeds ½ radian.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A liquid ring compressor for compressing a compressible fluid comprising:

a stationary shaft having a radius C;

a casing mounted on said shaft for rotation about a first axis and having an inner cylindrical surface of radius R with respect to said first axis;

an impeller mounted on said shaft for rotation eccentrically in said casing about a second axis parallel to and spaced a distance E from said first axis;

said impeller having a core with a radius C and a plurality of vanes spaced from each other around said core with each vane extending outwardly from said core to a tip in a radial direction with respect to said second axis such that the vanes are directed towards and lie within said inner cylindrical surface;

a drive mechanically coupled to said casing to rotate said casing at a first velocity, whereby liquid in the casing flows in an annular ring on the inner cylindrical surface of the casing; and wherein, the quantities E, C, and R have the relationship: $E<(R/3)(1-C/R)$ thereby ensuring that each of said vanes remains in operative engagement with said annular ring of liquid throughout each complete rotation of the impeller relative to said casing.

2. The liquid ring compressor according to claim 1 wherein the radial distance between said core and the tip of each vane is less than the minimum space between the inner surface of the casing and core of the impeller whereby the tips of the vanes remain spaced from and out of sliding engagement with said inner cylindrical surface during each complete rotation of said impeller relative to said casing.

3. The liquid ring compressor according to claim 1 wherein said drive includes a ring gear on said casing and a mating pinion gear on said impeller.

4. The liquid ring compressor according to claim 1 wherein said first and second axes are located in said shaft.

* * * * *